US012318675B2

(12) United States Patent
Payne

(10) Patent No.: US 12,318,675 B2
(45) Date of Patent: Jun. 3, 2025

(54) PENDULUM GAME APPARATUS

(71) Applicant: Chase Payne, Las Vegas, NV (US)

(72) Inventor: Chase Payne, Las Vegas, NV (US)

( * ) Notice: Subject to any disclaimer, the term of this patent is extended or adjusted under 35 U.S.C. 154(b) by 628 days.

(21) Appl. No.: 17/691,098

(22) Filed: Mar. 9, 2022

(65) Prior Publication Data

US 2022/0288477 A1 Sep. 15, 2022

Related U.S. Application Data

(60) Provisional application No. 63/158,555, filed on Mar. 9, 2021.

(51) Int. Cl.
*A63B 67/10* (2006.01)
*A63D 7/00* (2006.01)
*A63F 11/00* (2006.01)

(52) U.S. Cl.
CPC ..... *A63B 67/10* (2013.01); *A63D 7/00* (2013.01); *A63F 2011/0013* (2013.01)

(58) Field of Classification Search
CPC .... A63B 67/10; A63D 7/00; A63F 2011/0013
See application file for complete search history.

(56) References Cited

U.S. PATENT DOCUMENTS 1,604,047 A * 10/1926 Hinz ..... A63D 7/00 473/108
1,871,143 A * 8/1932 Bonham ..... A63D 7/00 473/108
2,212,163 A * 8/1940 Mangold ..... A63D 7/00 473/80
2,329,344 A * 9/1943 Engstrom ..... A63D 7/00 473/108
2,616,697 A * 11/1952 Brasington ..... A63B 67/10 273/331
2,634,977 A * 4/1953 Hunter ..... A63D 7/00 D21/309

(Continued)

FOREIGN PATENT DOCUMENTS

CH 662061 A * 9/1987 ..... A63D 7/00
DE 2814740 A * 10/1978 ..... A63B 67/10

(Continued)

*Primary Examiner* — Raleigh W Chiu
(74) *Attorney, Agent, or Firm* — The Thornton Firm, LLC

(57) ABSTRACT

An improved pendulum game apparatus includes a cuboid shaped roof assembly; a cuboid shaped foundation assembly; a frame assembly which connects the cuboid shaped roof assembly with the cuboid shaped foundation assembly, the frame assembly consisting of at least two collapsible cross brace assemblies, each cross brace assembly consisting of four frame arms and a crossmember bracket, the crossmember bracket configured to accept the four frame arms so as to create a cross brace when assembled; a target structure stand assembly, the target structure stand assembly being connectible to the upper side of the base of the cuboid shaped foundation assembly; a plurality of target structures movably attached to the said target structure stand assembly; a pendulum arm; a pendulum cable; and a pendulum bob. The improved pendulum game can include a computer system which enhances the game experience.

20 Claims, 6 Drawing Sheets

(56) References Cited

U.S. PATENT DOCUMENTS

| | | | | | |
|---|---|---|---|---|---|
| 2,950,917 | A * | 8/1960 | Lyon | A63F 9/02 | 273/332 |
| 3,738,647 | A * | 6/1973 | Morrill | A63D 7/00 | 473/78 |
| 3,883,140 | A * | 5/1975 | Becker | A63B 67/10 | 273/331 |
| 2008/0015058 | A1 * | 1/2008 | Noble | A63B 63/007 | 473/423 |
| 2022/0288477 | A1 * | 9/2022 | Payne | A63B 67/10 | |
| 2023/0126962 | A1 * | 4/2023 | Christoph | A63B 67/06 | 273/332 |

FOREIGN PATENT DOCUMENTS

| | | | | | |
|---|---|---|---|---|---|
| DE | 20101819 | U1 * | 5/2001 | A63D 7/00 | |
| DE | 20201591 | U1 * | 1/2003 | A63D 7/00 | |
| WO | WO-8503883 | A1 * | 9/1985 | A63D 7/00 | |

* cited by examiner

PENDULUM GAME APPARATUS

CROSS-REFERENCE TO RELATED APPLICATIONS

The present utility patent application claims priority benefit of the U.S. provisional application for patent Ser. No. 63/158,555 titled "Improved Pendulum Game Apparatus" filed on Mar. 9, 2021 under 35 U.S.C. 119(e). The contents of this related provisional application are incorporated herein by reference for all purposes to the extent that such subject matter is not inconsistent herewith or limiting hereof.

RELATED CO-PENDING U.S. PATENT APPLICATIONS

Not applicable.

FEDERALLY SPONSORED RESEARCH OR DEVELOPMENT

Not applicable.

REFERENCE TO SEQUENCE LISTING, A TABLE, OR A COMPUTER LISTING APPENDIX

Not applicable.

COPYRIGHT NOTICE

A portion of the disclosure of this patent document contains material that is subject to copyright protection. The copyright owner has no objection to the facsimile reproduction by anyone of the patent document or patent disclosure as it appears in the Patent and Trademark Office, patent file or records, but otherwise reserves all copyright rights whatsoever.

BACKGROUND OF THE INVENTION

1. Field of the Invention

The invention relates generally to the field of games. More specifically, the present invention relates to an improved pendulum game apparatus.

2. Description of the Related Art

Pendulum bowling-style games are known in the art. In such games a player uses the mass or bob of a pendulum to strike objects. Points are scored depending on the objects the player hits. The one who accumulates the most points in a game is the winner.

While interesting and entertaining, though, such pendulum games have proven to be inefficient in the way the target objects may be set in place. Furthermore, such pendulum games have proven to be inefficient in the manner in which the targets may be put back in place after a pendulum mass or bob strikes them. Additionally, such pendulum games lack specialty targets for additional challenges. Moreover, existing pendulum games lack portability and ease of setup. Finally, such pendulum games lack today's computer implemented special effects seen in places such as arcades or clubs.

SUMMARY

The object of the present invention is to provide an improved pendulum game apparatus that provides players with an enhanced hand-eye coordination gaming experience while simultaneously offering the player an understanding into the laws of pendulum physics.

At its essence, the present invention is directed towards an improved pendulum game apparatus comprising a cuboid shaped roof assembly having a base and four side walls; a cuboid shaped foundation assembly having a base and four side walls; a frame assembly which connects the cuboid shaped roof assembly with the cuboid shaped foundation assembly, said frame assembly consisting of two collapsible cross brace assemblies, each cross brace assembly consisting of four frame arms and a crossmember bracket, said crossmember bracket configured to accept the said four frame arms so as to create a cross brace when assembled; a target structure stand assembly, said target structure stand assembly being connectible to the upper side of the base of the foundation assembly; a plurality of target structures movably attached to the said target structure stand assembly; a pendulum arm having a proximal end and a distal end; a pendulum cable; and a pendulum bob.

The improved pendulum game apparatus can be readily implemented across a wide variety of forms and media including, but not limited to, a small tabletop version, a standard home version or an upgraded arcade version. Actuator means may be incorporated so as to reset the target structures. Additionally, embodiments of the present invention can be readily configured to incorporate a wide variety of computer, sound and video effects to provide the players with an enhanced gaming experience. Moreover, the invention rules can be readily implemented in software, which can be stored on a readable medium and used in conjunction with a computer system to provide a wide variety of uses.

BRIEF DESCRIPTION OF THE DRAWINGS

The invention directed by way of example, and not by way of limitation, in the figures of the accompanying drawings and in which like reference numerals refer to similar elements and in which.

Figure 1:
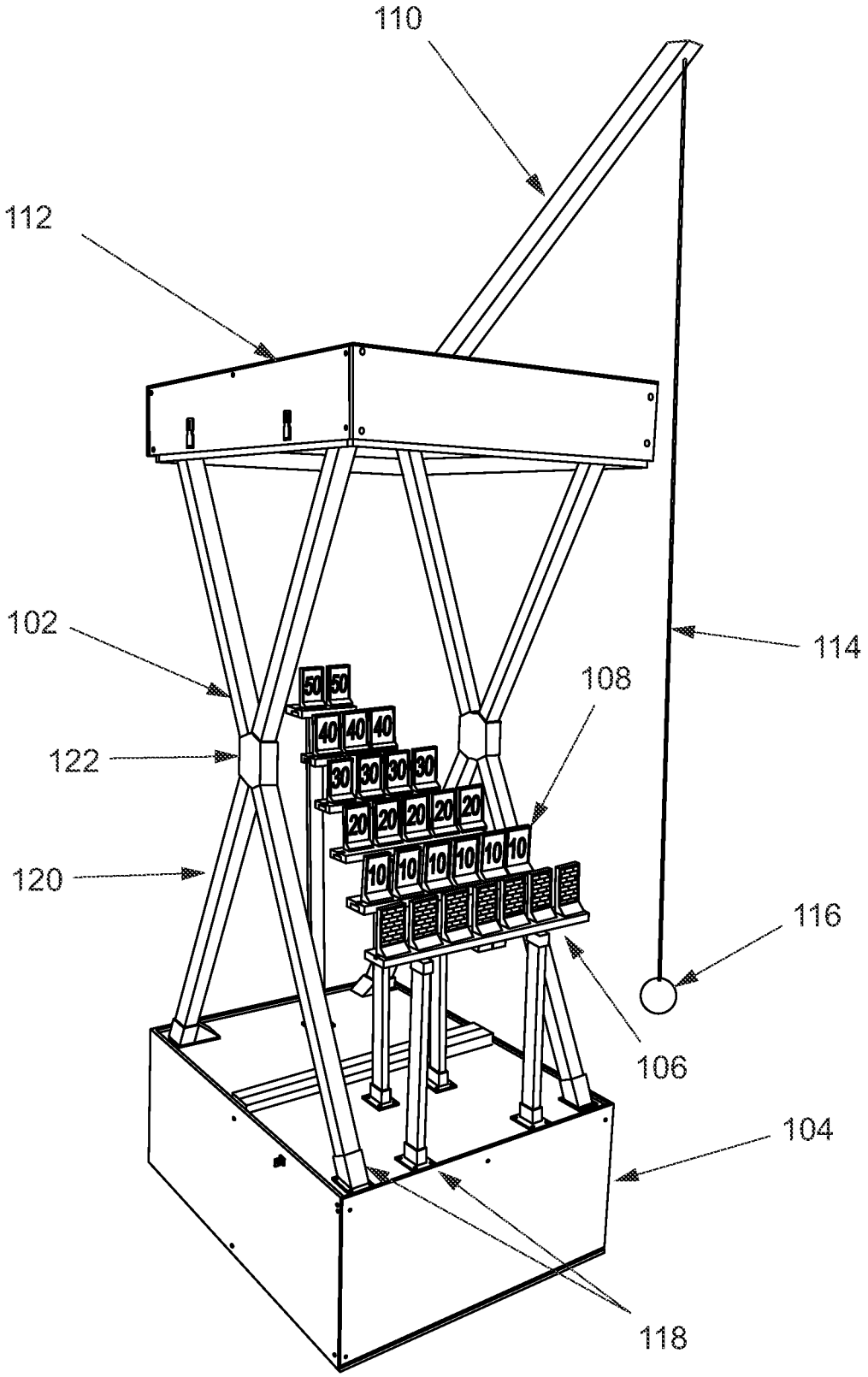
FIG. 1 illustrates a perspective view of an exemplary improved pendulum game apparatus in accordance with an embodiment of the invention.

Unless otherwise indicated illustrations in the figures are not necessarily drawn to scale.

DETAILED DESCRIPTION OF THE PREFERRED EMBODIMENTS

Terminology used herein is used for the purpose of describing particular embodiments only, and is not intended to limit the scope of the present invention. It must be understood that as used herein and in the appended claims, the singular forms "a," "an," and "the" include the plural reference unless the context clearly dictates otherwise. For example, a reference to "an element" is a reference to one or more elements and includes all equivalents known to those skilled in the art. All conjunctions used are to be understood in the most inclusive sense possible. Thus, the word "or" should be understood as having the definition of a logical "or" rather than that of a logical "exclusive or" unless the context clearly necessitates otherwise. Language that may be construed to express approximation should be so understood unless the context clearly dictates otherwise.

Unless defined otherwise, all technical and scientific terms used herein have the same meanings as commonly understood by a person of ordinary skill in the art to which this invention belongs. Preferred methods, techniques, devices, and materials are described. But any methods, techniques, devices, or materials similar or equivalent to those described herein may be used in the practice or testing of the present invention. Structures described herein should also be understood to refer to functional equivalents of such structures.

References to "one embodiment," "one variant," "an embodiment," "a variant," "various embodiments," "numerous variants," etc., may indicate that the embodiment(s) of the invention so described may include particular features, structures, or characteristics. However, not every embodiment or variant necessarily includes the particular features, structures, or characteristics. Further, repeated use of the phrase "in one embodiment," or "in an exemplary embodiment," or "a variant," or "another variant," do not necessarily refer to the same embodiment although they may. A description of an embodiment with several components in communication with each other does not imply that all such components are required. On the contrary, a variety of optional components are described to illustrate the wide variety of possible embodiments and/or variants of the present invention.

A "pendulum" is a mass, also known as a bob, suspended from a pivot so that it can swing freely. When a pendulum is displaced sideways from its resting, equilibrium position, it is subject to a restoring force due to gravity that will accelerate it back toward the equilibrium position. When released, the restoring force acting on the pendulum's mass causes it to oscillate about the equilibrium position, swinging back and forth. The time for one complete cycle, a left swing and a right swing, is known as the period. The period depends on the length of the pendulum and also to a slight degree on the amplitude, the width of the pendulum's swing.

A "computer" may refer to one or more apparatus and/or one or more systems that are capable of accepting a structured input, processing the structured input according to prescribed rules, and producing results of the processing as output. Examples of a computer may include: a personal computer (PC); a stationary and/or portable computer; a computer having a single processor, a computer having multiple processors, or a computer having multi-core processors, which may operate in parallel and/or not in parallel; a general purpose computer; a supercomputer; a mainframe; a super mini-computer; a mini-computer; a workstation; a micro-computer; a server; a client; an interactive television; a web appliance; a telecommunications device with internet access; a hybrid combination of a computer and an interactive television; a portable computer; a tablet personal computer; a personal digital assistant (PDA); a portable telephone; a portable smartphone; wearable devices such as smartwatches; application-specific hardware to emulate a computer and/or software, such as, for example, a digital signal processor (DSP), a field-programmable gate array (FPGA), an application specific integrated circuit (ASIC), an application specific instruction-set processor (ASIP), a chip, chips, a system on a chip, or a chip set; a data acquisition device; an optical computer; a quantum computer; a biological computer; and generally, an apparatus that may accept data, process data according to one or more stored software programs, generate results, and typically include input, output, storage, arithmetic, logic, and control units.

The term "processor" may refer to any device or portion of a device that processes electronic data from registers and/or memory to transform that electronic data into other electronic data that may be stored in registers and/or memory. A "computing platform" may comprise one or more processors.

A "microcontroller" generally refers a small computer on a single integrated circuit. A microcontroller contains one or more central processing units (processor cores) along with memory and programmable input/output peripherals. A typical microcontroller includes a processor, memory and input/output (I/O) peripherals on a single chip.

An algorithm is generally considered to be a self-consistent sequence of acts or operations leading to a desired result. These include physical manipulations of physical quantities. Usually, though not necessarily, these quantities take the form of electrical or magnetic signals capable of being stored, transferred, combined, compared, and otherwise manipulated. It has proven convenient at times, principally for reasons of common usage, to refer to these signals as bits, values, elements, symbols, characters, terms, numbers or the like. It should be understood, however, that all of these and similar terms are to be associated with the appropriate physical quantities and are merely convenient labels applied to these quantities.

It will be readily understood by persons skilled in the art that the various methods and algorithms described herein may be implemented by appropriately programmed computers and computing devices. Typically, a processor (e.g., a microprocessor) will receive instructions from a memory or like device, and execute those instructions, thereby performing a process defined by those instructions. Further, programs that implement such methods and algorithms may be stored and transmitted using a variety of known media.

"Software" may refer to prescribed rules and/or instructions used to operate a computer. Examples of software may include: code segments in one or more computer-readable languages; graphical and or/textual instructions; applets; pre-compiled code; interpreted code; compiled code; and computer programs. An operating system or "OS" is software that manages computer hardware and software resources and provides common services for computer programs.

The example embodiments described herein can be implemented in an operating environment comprising computer-executable instructions (e.g., software) installed on a computer, in hardware, or in a combination of software and hardware. The computer-executable instructions can be written in a computer programming language or can be embodied in firmware logic. If written in a programming language conforming to a recognized standard, such instructions can be executed on a variety of hardware platforms and for interfaces to a variety of operating systems. Although not limited thereto, computer software program code for carrying out operations for aspects of the present invention can be written in any combination of one or more suitable programming languages, including an object oriented programming languages and/or conventional procedural programming languages, and/or programming languages such as, for example, Hypertext Markup Language (HTML), Dynamic HTML, Extensible Markup Language (XML), Extensible Stylesheet Language (XSL), Document Style Semantics and Specification Language (DSSSL), Cascading Style Sheets (CSS), Synchronized Multimedia Integration Language (SMIL), Wireless Markup Language (WML), Java™, Jini™, C, C++, Smalltalk, Perl, UNIX Shell, Visual Basic or Visual Basic Script, Virtual Reality Markup Language (VRML), ColdFusion™, SQL, Python. or other compilers, assemblers, interpreters or other computer languages or platforms.

A "computer-readable medium" may refer to any storage device used for storing data accessible by a computer. Examples of a computer-readable medium may include: a magnetic hard disk; a floppy disk; an optical disk, such as a CD-ROM and a DVD; a magnetic tape; a flash memory; a memory chip; and/or other types of media that can store machine-readable instructions thereon.

A "non-transitory computer readable medium" includes, but is not limited to, a hard drive, compact disc, flash memory, volatile memory, random access memory, magnetic memory, optical memory, semiconductor-based memory, phase change memory, optical memory, periodically refreshed memory, and the like; however, the non-transitory computer readable medium does not include a pure transitory signal per se.

A "computer system" may refer to a system having one or more computers, where each computer may include a computer-readable medium employing software to operate the computer or one or more of its components. Examples of a computer system may include: a distributed computer system for processing information via computer systems linked by a network; two or more computer systems connected together via a network for transmitting and/or receiving information between the computer systems; a computer system including two or more processors within a single computer; and one or more apparatuses and/or one or more systems that may accept data, may process data in accordance with one or more stored software programs, may generate results, and typically may include input, output, storage, arithmetic, logic, and control units.

A "network" may refer to a plurality of computers and associated devices that may be connected by communication channels to facilitate communication and resource sharing. A network may involve permanent connections such as cables or temporary connections such as those made through telephone, cable, wireless or other communication links. A network may further include hard-wired connections (e.g., coaxial cable, twisted pair, optical fiber, waveguides, etc.) and/or wireless connections (e.g., radio frequency waveforms, free-space optical waveforms, acoustic waveforms, etc.). Examples of a network may include, but are not limited to, an internet, such as the Internet or World Wide Web; an intranet; a personal area network (PAN); near field communication (NFC); a local area network (LAN); a wide area network (WAN); a virtual private network (VPN); internet of things (IoT); Blockchain; and a combination of networks, such as an internet and an intranet.

Exemplary networks may operate with any of a number of protocols such as, but not limited to, Transmission Control Protocol (TCP), Internet protocol (IP), Internet Address Protocol (IP Address), asynchronous transfer mode (ATM), Near Field Communication digital protocol, and/or synchronous optical network (SONET), user datagram protocol (UDP), IEEE 802.x, etc.

"Video" may refer to motion pictures represented in analog and/or digital form. Examples of video may include television, movies, image sequences from a camera or other observer, and computer-generated image sequences. Video may be obtained from, for example, a live feed, a storage device, an IEEE 1394-based interface, a video digitizer, a computer graphics engine, or a network connection.

Embodiments of the interactive improved pendulum game apparatus may include more than one apparatus for performing the operations disclosed herein. An apparatus may be specially constructed for the desired purposes, or it may comprise one or more general-purpose devices selectively activated or reconfigured by a program stored in the device. Moreover, embodiments of the improved pendulum game apparatus may employ differing shapes and sizes to achieve a custom appearance.

Embodiments of the interactive improved pendulum game apparatus may also be implemented in, or in a combination of, hardware, firmware, and software. Such embodiments may be implemented as instructions stored on a machine-readable medium, which may be read and executed by a computing platform to perform the operations described herein.

Unless specifically stated otherwise, and as may be apparent from the following description and claims, it should be understood that throughout this application's specification, descriptions utilizing terms such as "processing," "computing," "calculating," "determining," or the like, refer to the actions and/or processes of a computer, computing system, or any similar electronic computing device which manipulates and/or transforms data represented as physical quantities within the computing system's registers and/or memories into other data similarly represented as physical quantities within the computing system's memories, registers or other such information storage, transmission or display devices.

Aspects of the exemplary interactive improved pendulum game apparatus will be described below with reference to flowchart illustrations and/or block diagrams of methods, steps, apparatus (systems) and computer program products according to embodiments of the invention. Persons skilled in the art will understand that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks.

The flowchart and block diagrams in the figures illustrate the rules, architecture, functionality, and operation of possible implementations of systems, methods and computer program products according to various embodiments of the exemplary improved pendulum game apparatus. It will become readily apparent to persons skilled in the art that each block in the flowchart or block diagrams may represent a module, segment, or portion of code, which comprises one or more executable instructions for implementing the specified logical function(s). It will also be readily apparent to persons skilled in the art that in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. Although process steps, method steps, algorithms or the like may be described in a sequential order, such processes, methods and algorithms may be configured to work in alternate orders. In other words, any sequence or order of steps that may be described does not necessarily indicate a requirement that the steps be performed in that order. The steps of processes described herein may be performed in any practical order.

It will also be understood by persons skilled in the art that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions. These computer program instructions may also be stored in a computer readable medium that can direct a computer, other programmable data processing apparatus, or other devices to function in a particular manner, such that the instructions stored in the computer readable medium produce an article of manufacture including instructions which implement the function/act specified in the flowchart and/or block diagram blocks.

When a single device or article is described herein, it will be readily apparent to persons having skill in the art that more than one device or article or/machine (whether or not they cooperate) may be used in place of a single device or article or machine. Similarly, where more than one device or article or machine is described herein (whether or not they cooperate), it will be readily apparent that a single device/article may be used in place of the more than one device or article. Likewise, the functionality and/or the features of a device or article or machine may be alternatively embodied by one or more other devices or articles or machines which are not explicitly described as having such functionality and/or features. Thus, other embodiments of the present invention need not include a specific device in and of itself.

As is well known to those skilled in the art, many careful considerations and compromises typically must be made when designing the optimal manufacture or commercial implementation of such an improved pendulum game apparatus. A commercial implementation in accordance with the spirit and teachings of the invention may be configured according to the needs of the particular application, whereby any aspect(s), feature(s), function(s), result(s), component(s), approach(es), or step(s) of the teachings related to any described embodiment of the present invention may be suitably omitted, included, adapted, mixed and matched, or improved and/or optimized by those skilled in the art.

Systems will be described and provided with means and methods for providing and implementing an improved pendulum game apparatus. The exemplary improved pendulum game apparatus will now be described in detail with reference to embodiments thereof as illustrated in the accompanying drawings.

FIG. 1 illustrates a perspective view of an exemplary improved pendulum game apparatus in accordance with an embodiment of the invention. At its essence, the improved pendulum game apparatus comprises a frame assembly 102, a cuboid shaped foundation assembly 104 having a base and four side walls, a target structure stand assembly 106, a plurality of target structures 108, a pendulum arm 110 having a proximal and distal end, a cuboid shaped roof assembly 112 having a base and four side walls, a pendulum cable 114, and a pendulum mass or bob 116. The frame assembly 102 connects the cuboid shaped roof assembly 112 with the cuboid shaped foundation assembly 104. The frame assembly consists of at least two collapsible cross brace assemblies, each cross brace assembly consisting of four frame arms 120 and a crossmember bracket 122. Each crossmember bracket is configured to accept the four frame arms so as to create a cross brace when assembled. Each cross brace provides added stability while allowing for access from all sides of the improved pendulum game apparatus.

The target structure stand assembly 106 attaches to, and extends upwards from, the base of the cuboid shaped foundation assembly 104. The target structure stand assembly is configured so as to allow a pendulum bob or mass to travel along its arc and knock down target structures. In other words, the target structure stand assembly will include multiple rows of targets positioned at various heights corresponding with the travel arc of a pendulum bob. It will be understood by persons having skill in the art that the frame assembly 102 may be enclosed through the use of panels secured to the frame assembly 102.

In one embodiment of the invention, the frame assembly 102 consists of at least two collapsible cross brace assemblies, each cross brace assembly consisting of four frame arms 120 and a crossmember bracket 122. Each crossmember bracket is configured to accept the four frame arms so as to create a cross brace when assembled. Each cross brace provides added stability while allowing for access from all sides of the improved pendulum game apparatus. The frame assembly 102 connects the cuboid shaped roof assembly 112 with the cuboid shaped foundation assembly 104. The frame arms can be made of various materials such as wood, metal or plastic.

In an embodiment of the invention, the frame assembly 102 which connects the cuboid shaped roof assembly with the cuboid shaped foundation assembly includes a third collapsible cross brace assembly consisting of four frame arms 120 and a crossmember bracket 122. The third collapsible cross brace assembly connects the posterior sides of the base of the foundation assembly and the base of the roof assembly. The third cross brace assembly adds additional support and rigidity to the improved pendulum game apparatus while allowing users to easily disassemble the game.

The improved pendulum game apparatus can be easily disassembled and reassembled. In one embodiment of the invention, the cuboid shaped roof assembly 112 having a base and four side walls and the cuboid shaped foundation assembly 104 having a base and four side walls can be fastened together at the side walls to form a cuboid shaped storage container. Both the cuboid shaped roof assembly 112 and the cuboid shaped foundation assembly 104 have a space created by the base and four walls and, when put together, create an ideal storage container suitable for transportation and easy set up and take down. The assemblies can be made from various materials such as, but not limited to, wood, metal or plastic. Such a storage container can be configured to store the individual components of the improved pendulum game apparatus inside the storage container. The storage container could then be easily transported from location to location. By way of example, and not limitation, an improved pendulum game apparatus could be transported to a specific location such as a party or other entertainment event. The use of multiple cross brace assemblies in conjunction with a roof assembly and a foundation assembly create a sturdy structure capable of withstanding impacts from persons and pendulum bobs alike. The improved pendulum game apparatus can be easily disassembled and stored after events.

Attachably extending from the cuboid shaped roof assembly 112 is a pendulum arm 110 having a proximal end and a distal which is held in place and at a specific angle by a fixed mounting point located on the top side of the cuboid shaped roof assembly 112. The pendulum ball or mass or bob 116 is suspended by a pendulum cable 114 and hangs from the pendulum arm 110. In other words, the pendulum cable 114 is connected to the distal end of the pendulum arm 110. It will be understood by persons having skill in the art that the length of the pendulum cable 114 corresponds with the length of the pendulum arm 110 and the height of the target structure stand assembly 106 and target structures 108. In other words, the pendulum mass or bob 116 will be configured relative to its other components to strike target structures along its travel path. The pendulum arm is specifically configured to create a pendulum travel path which aligns with the target structure stand and target structures, and may attach to the top of the cuboid shaped roof assembly by numerous means known and appreciated in the art such as, but not limited to, screws, pins, clamps and fasteners.

Custom mounting points 118 connect the frame assembly and the target structure stand assembly to the cuboid shaped foundation assembly having a base and four side walls. In one embodiment of the invention, the custom mounting points are made from a plastic substance known and appreciated in the art. Mounting points can be created via 3D printing or can be molded. However, persons skilled in the art will appreciate that other means such as, but not limited to grooves or slots inside the base can be used to create mounting points. Persons having skill in the art will appreciate that frame arms and stand units will slide into the custom mounting points and will be held in place by means as simple as friction or by other attachment means such as, but not limited to, screws, cotter pins, pegs, or other attachment means known and appreciated in the art. The custom mounting points 118 can be attached to the cuboid shaped roof assembly 112 and the cuboid shaped foundation assembly 104 by various means such as, but not limited to, screws, adhesives, or other fastener mechanisms known and appreciated in the art. Such custom mounting points will keep the cross beam assemblies of the frame assembly in a rigid and secure position.

Figure 2:
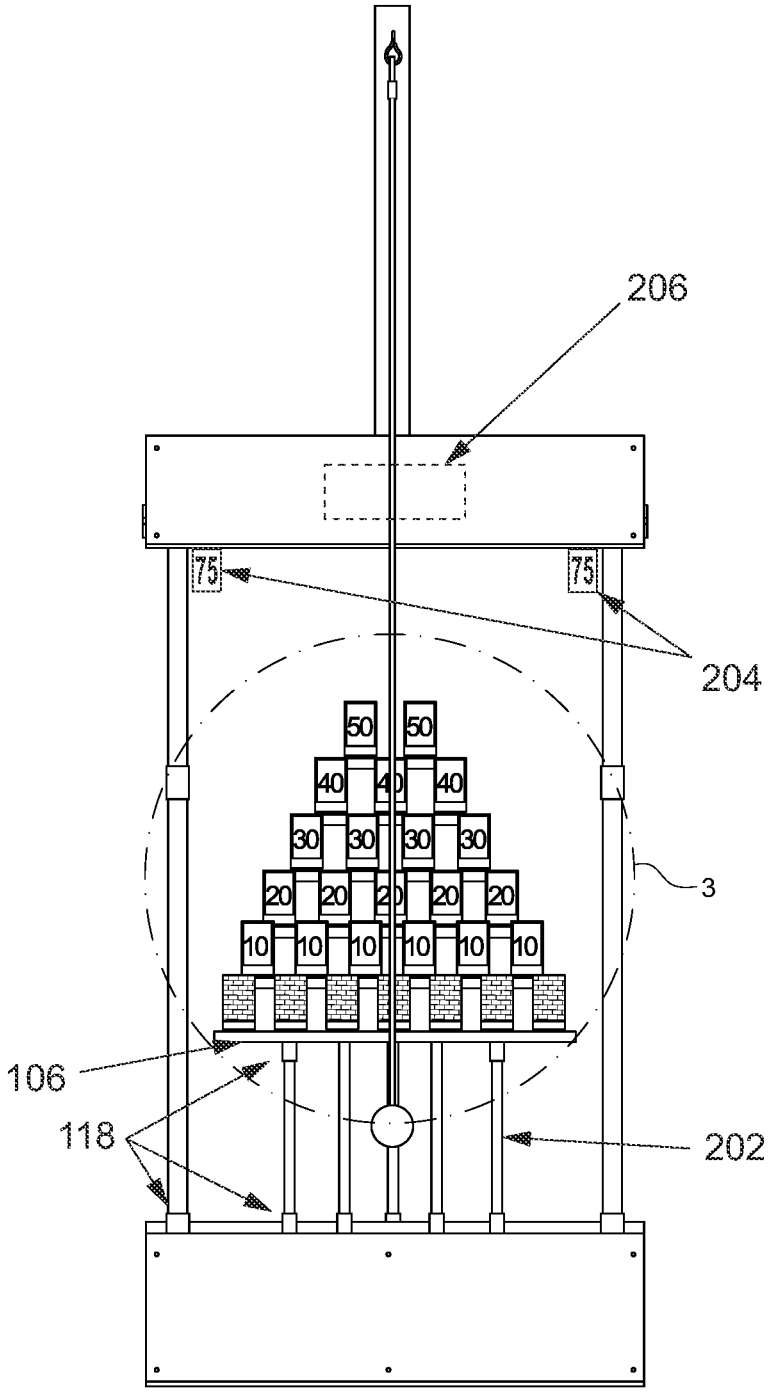
FIG. 2 illustrates a front elevation view of an exemplary improved pendulum game apparatus in accordance with an embodiment of the invention.

FIG. 2 illustrates a front elevation view of an exemplary improved pendulum game apparatus in accordance with an embodiment of the invention. In this view, the target structure stand 106 may be configured to attach to individual stand units 202. The individual stand units can attach to custom mounting points 118. In one embodiment of the invention, the custom mounting points 118 are plastic structures capable of attaching to the cuboid shaped roof assembly 112 and the cuboid shaped foundation assembly 104. In other embodiments, the custom mounting points 118 can be apertures in the base unit of the cuboid shaped roof assembly 112 and the cuboid shaped foundation assembly 104. The target structure stand is designed to support target structures in such a manner so as to follow a pendulum's arc. In addition to the standard target structures, specialty target structures 204 may be incorporated into the game where a player uses the pendulum to strike specialty targets or to land in specialty target buckets which are more difficult to land a traveling pendulum bob. In one embodiment of the invention, specialty targets 204 are mounted to the frame assembly which connects the cuboid shaped roof assembly with the cuboid shaped foundation assembly, said frame assembly consisting of two collapsible cross brace assemblies. In another embodiment of the invention, specialty target structures 204 can be attached to the cuboid shaped roof assembly. Persons having skill in the art will readily appreciate that numerous specialty target structures can be created through creative methods. In addition to target structures, various other targets may be mounted on the a back panel attached to the frame or top unit.

In embodiments of the invention, a computer system 206 may be incorporated into the improved pendulum game so as to provide players enhanced visual and sound effects. In this view, a computer system is shown as integrated into the cuboid shaped roof assembly. Such a configuration can allow for the efficient placement of various peripherals such as, but not limited to, LED light fixtures, loudspeakers and various networked input/output devices. Persons having skill in the art will readily appreciate that there are numerous computer implemented means capable of providing players an enhanced playing experience. The computer system includes at least one processor and memory storing computer readable instructions, and is networked with peripherals and the internet. Sensors may be incorporated in any number of ways to send signals to a computer where the computer may perform a set of given instructions. In this view, the computer effects module rests above the frame assembly. However, various ways and means may be implemented to achieve enhanced effects. Persons having skill in the art will readily appreciate that there are numerous computer-implemented means capable of providing players an enhanced playing experience such as, but not limited to, audiovisual effects related to building demolition through the use of a crane and wrecking ball. Moreover, such a computer implemented addition could provide a revenue generating game capable of being licensed to establishments such as, but not limited to, game rooms, billiard parlors, bars, clubs, arcades and restaurants. Finally, such a computer implemented system can be networked with personal computers, tablets, and smartphones so as to create a game interface which can create player profiles, display scores, display rankings, and share such a gaming experience on social media platorms.

Figure 3:
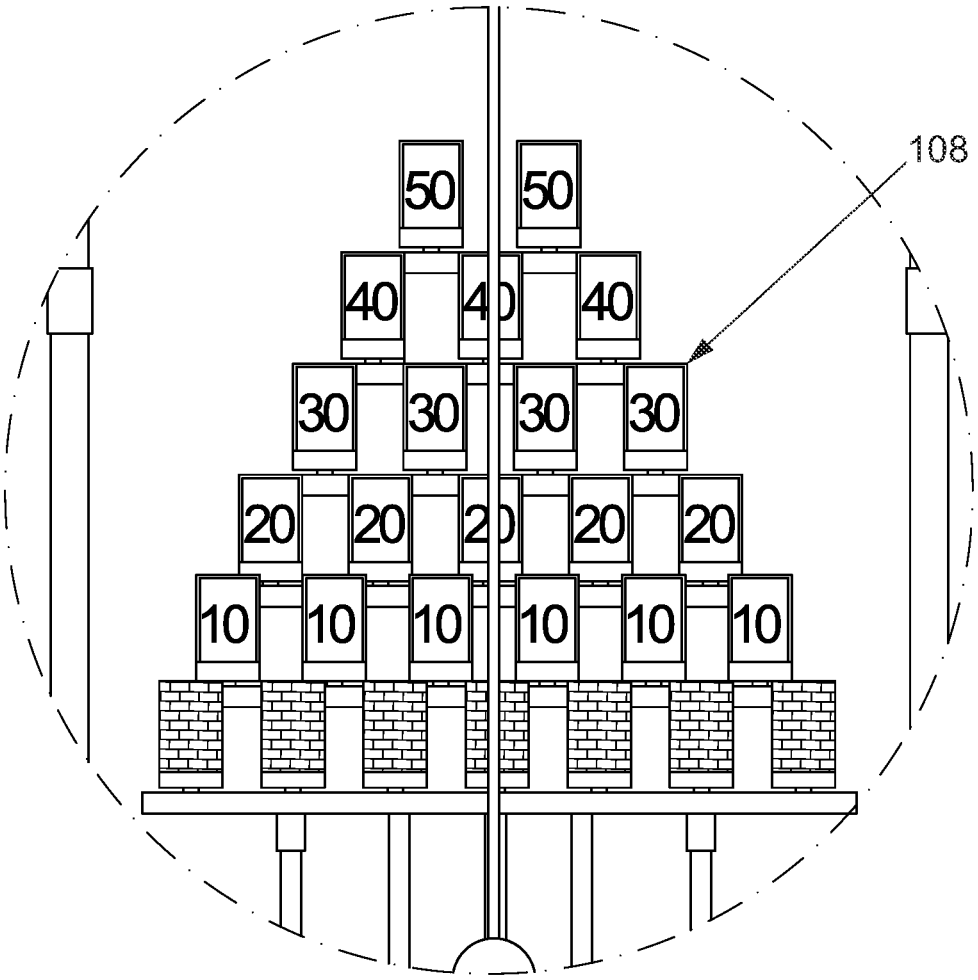
FIG. 3 illustrates a front elevation view of an exemplary improved pendulum game apparatus in accordance with an embodiment of the invention

FIG. 3 illustrates a front elevation view of an exemplary improved pendulum game apparatus in accordance with an embodiment of the invention. In this view, the anterior or front facing side of the game is shown with target structures 108 arranged in such a way where a traveling pendulum bob can knock one or more structures down as it travels in a pendulum arc trajectory. It is to be understood that more than one target structure can be knocked over by a traveling pendulum bob. In this view, the arrangement of target structures corresponds to a pendulum arc with each target structure higher than the target structure in front of it. Persons having skill in the art will appreciate than multiple rows of individual target structures can be used to create a more interesting game experience. In some embodiments of the invention, a pendulum bob having a greater mass can be used to increase momentum and kinetic energy.

Figure 4:
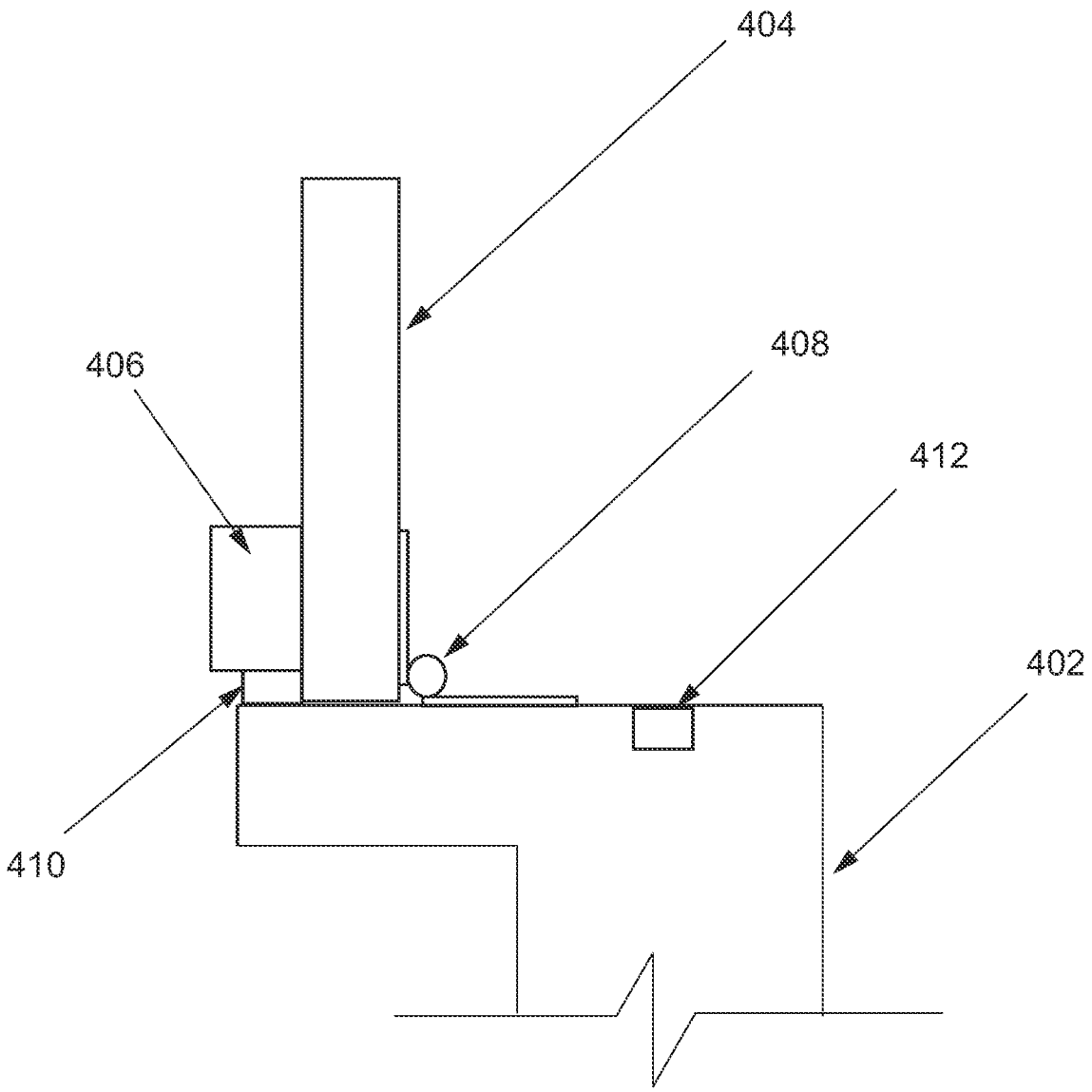
FIG. 4 illustrates a side elevation detail view of a knockdown tile assembly in accordance with an embodiment of the invention.

FIG. 4 illustrates a side elevation detail view of a target structure assembly in accordance with an embodiment of the invention. In this view, the top of an individual target structure stand 402 (see also 202) is shown with a target structure in a standing position. The target structure consists of a main target structure body 404 and a stabilizer bracket with attachment means 406. The attachment means 406 can be a simple appendage attached to the main target structure body 404. The attachment means 406 provides additional stability for target structures and prevent the target structures from falling forwards. Each target structure may be hingedly attached to the top of the target structure stand 402 through various means known and appreciated in the art. In other embodiments of the invention, a main target structure body can be created with an appendage which functions the same as the attachment means 406. In one embodiment, the target structures may be attached by a simple hinge means 408 known and appreciated in the art. In embodiments of the invention, the target structures can assume various shapes and sizes so as to create more difficult targets to hit, thus creating higher point value in a game. In another embodiment of the invention, the target structures may be attached by a rotational actuator means. In other embodiments of the invention, electromagnetic motors or solenoids can be incorporated into each target structure so as to create an automated reset mechanism.

In embodiments of the invention, the target structures 204 are made from a plastic material such as, but not limited to ABS (acrylonitrile butadiene styrene) plastic. However, other plastics such as polycarbonates, polyethelyne or polyvinyl chloride can be used. Other embodiments can use other materials such as wood, ivory or even stone. Numerous means known and appreciated in the art can be used to attach target structures made from differing materials together. The target structures 204 are assigned point values commensurate with the difficulty in which they are to knock down with a pendulum. Such structures are labeled.

A magnetic fastening means 410 can be used to hold the target structure in an upright position. A separate magnetic fastening means 412 may be used to hold the target structure in place when the structure is knocked down. The use of rare-earth magnets has made securing of target structures simpler and more efficient than common ferrite material magnets or electromagnets as the use of such magnets requires considerably less space thus providing markedly improved performance. Moreover, the use of magnetic fields may provide a signal means for computer implemented versions of the present invention. Persons skilled in the art will understand that the magnetic means for securing the target structures may also be used in a circuit to send a signal to a computer system so as to perform functions such as, but not limited to keeping score, providing audio and visual effects and to reset the target structures. Other means for sending signals to a computer system are also known and appreciated in the art.

Figure 5:
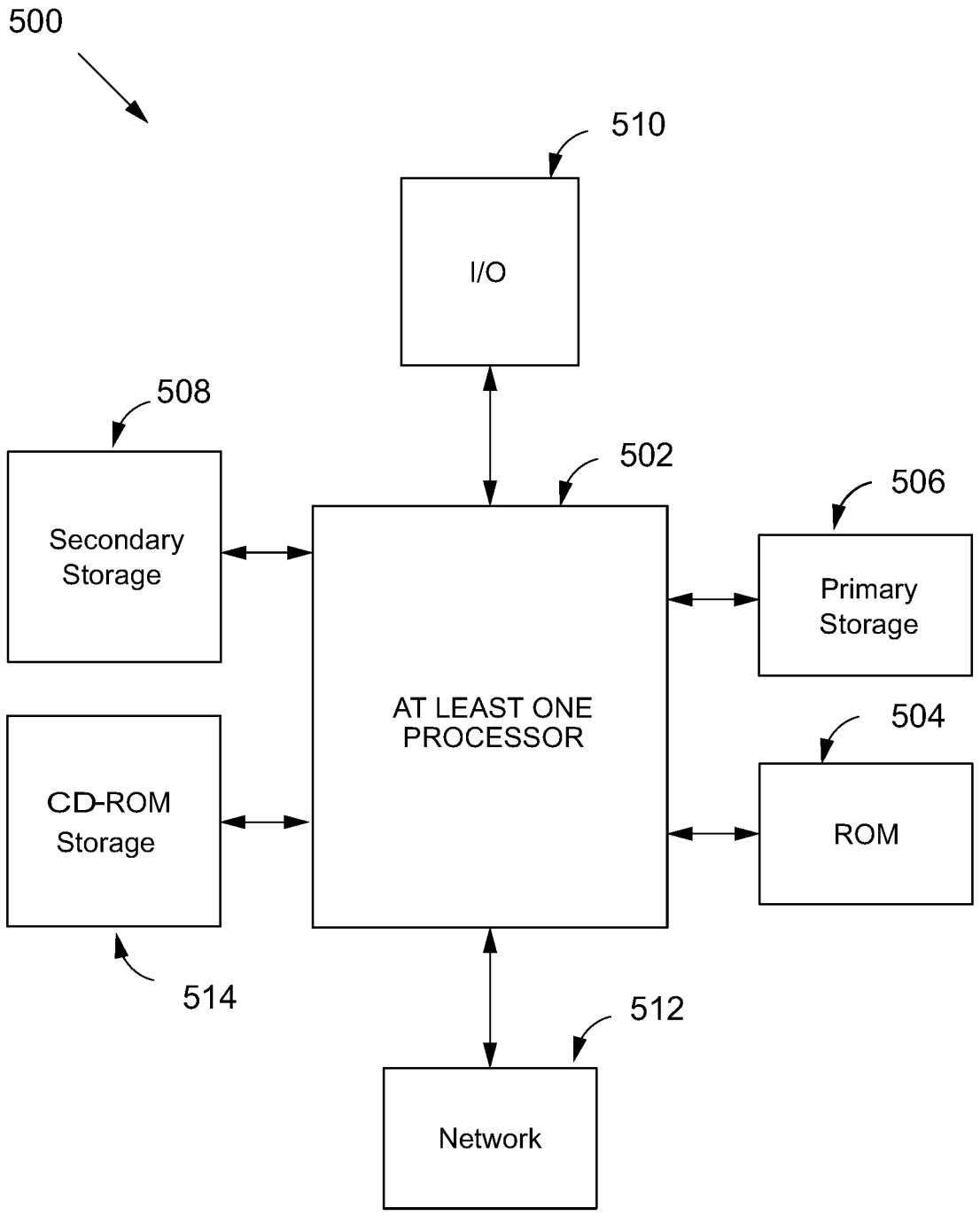
FIG. 5 illustrates a computer system that, when appropriately configured or designed, may serve as a computer system or for which the improved pendulum game apparatus may be embodied.

FIG. 5 illustrates a typical computer system that, when appropriately configured or designed, may serve as a computer system 500 for which the improved pendulum game apparatus may be configured.

The computer system 500 includes at least one processor 502 (also referred to as central processing units, or CPUs) that may be coupled to storage devices including a primary storage 506 (typically a random-access memory, or RAM), a primary storage 504 (typically a read-only memory, or ROM). CPU 502 may be of various types including microcontrollers (e.g., with embedded RAM/ROM) and microprocessors such as programmable devices (e.g., RISC or SISC based, or CPLDs and FPGAs) and devices not capable of being programmed such as gate array ASICs (Application Specific Integrated Circuits) or general purpose microprocessors. As is well known in the art, primary storage 504 acts to transfer data and instructions uni-directionally to the CPU and primary storage 506 typically may be used to transfer data and instructions in a bi-directional manner. The primary storage devices discussed previously may include any suitable computer-readable media such as those described above. A mass storage device 508 may also be coupled bi-directionally to CPU 502 and provides additional data storage capacity and may include any of the computer-readable media described above. Mass storage device 508 may be used to store programs, data and the like and typically may be used as a secondary storage medium such as a hard disk. It will be appreciated that the information retained within mass storage device 508, may, in appropriate cases, be incorporated in standard fashion as part of primary storage 506 as virtual memory. A specific mass storage device such as a CD-ROM 514 may also pass data uni-directionally to the CPU.

CPU 502 may also be coupled to an interface 510 that connects to one or more input/output devices or peripherals such as such as video monitors, LED displays, OLED displays, holographic displays, loudspeakers, track balls, mice, keyboards, microphones, touch-sensitive displays, transducer card readers, magnetic or paper tape readers, tablets, styluses, voice or handwriting recognizers, or other well-known input devices such as, of course, other computers. In one embodiment of the invention, a sensor can be added to the pendulum bob to provide telemetric data such as velocity and momentum. The pendulum cable can be used as a data transmission means. Finally, CPU 502 optionally may be coupled to an external device such as a database or a computer or telecommunications or internet network using an external connection shown generally as a network 512, which may be implemented as a hardwired or wireless communications link using suitable conventional technologies. With such a connection, the CPU might receive information from the network, or might output information to the network in the course of performing the method steps described in the teachings of the present invention.

It will be understood by persons having skill in the art that memory storing computer readable instructions that, when executed by the at least one processor, cause the improved pendulum game apparatus, by at least one processor, to perform the steps of certain functions such as, but not limited to, inputting the number of players, determining player order, receiving signals from input/output devices such as, but not limited to, sensors in the target structures, displaying audiovisual effects, tallying scores, determining rankings, and sharing scores and metrics over a network.

Figure 6:
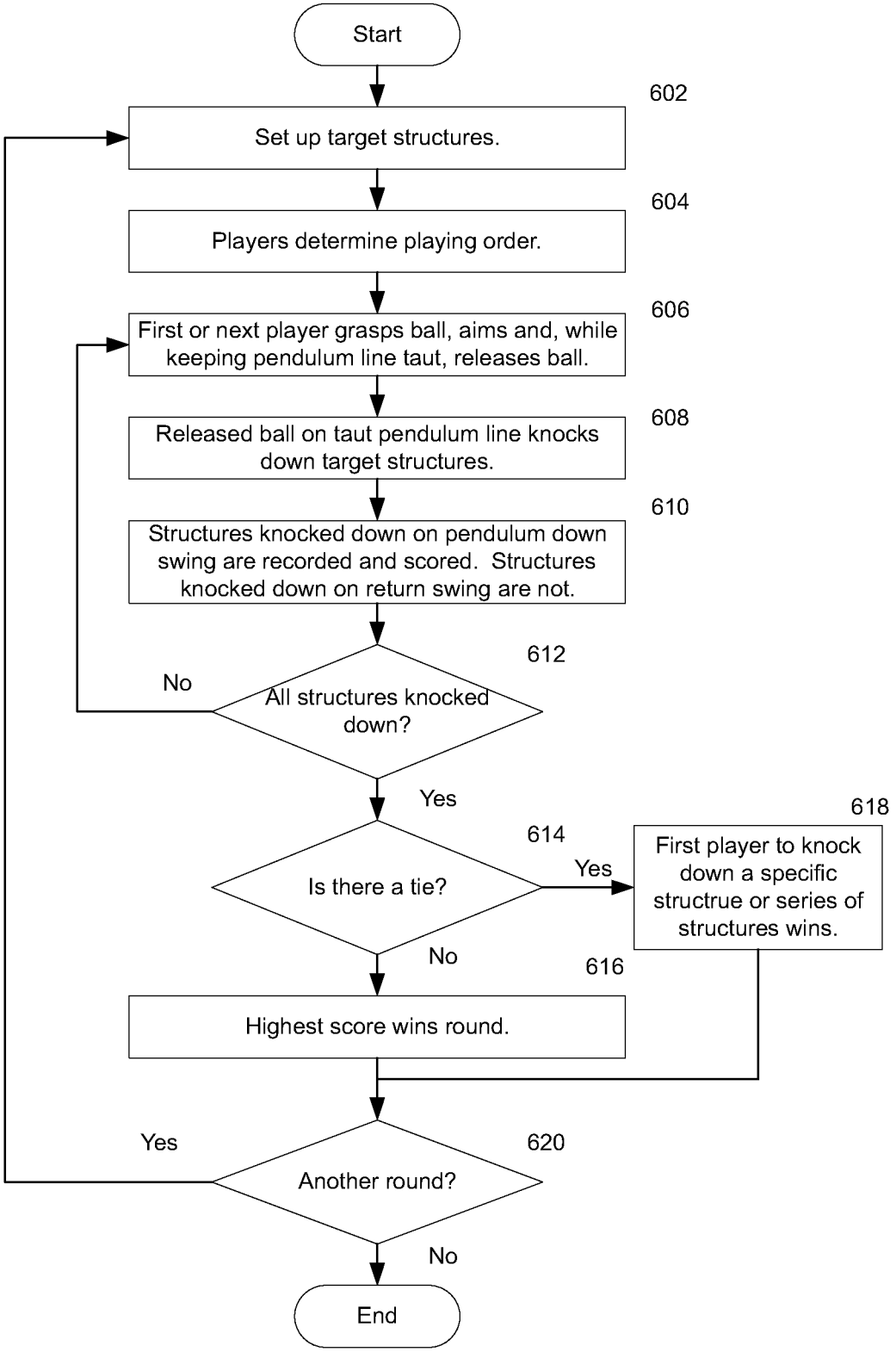
FIG. 6 illustrates a flowchart diagram representing the general rules of the improved pendulum game.

FIG. 6 illustrates a flowchart diagram representing the general rules of the improved pendulum game. The game begins by preparing the target structures for play 602. In some embodiments, the target structures may be manually placed in position by the players. In other embodiments, the target structures may be placed in position by rotational actuator means. After the target structures are prepared, the players may then determine the playing order 604 through various means such as, but not limited to, a coin toss or a mutually determined rule.

When the playing order is determined, the first player grasps the pendulum ball, and while keeping the pendulum cable taut pulls back the pendulum ball and releases the pendulum ball or bob on a trajectory towards the target stand and target structures 606. The released ball on the taut pendulum cable then swings towards the target stand and target structures and then strikes one or more target structures 608. The knocked down target structures are then scored and recorded commensurate with the degree of difficulty in striking the target structure 610. Scoring may be recorded either manually or through computer implemented means depending on the particular implementation of the exemplary improved pendulum gaming apparatus. When the target structures are all knocked down 612, the score is then tallied among the players. The highest score wins the round 616. In the event of a tie, the first player to hit and knock down a specific target structure or series of structures wins the round 618. The players may then determine whether to play another round 620.

Persons having skill in the art will readily appreciate that the aforementioned rules of the game may be implemented in various electronic and computer means. For example, and not limitation, a computer system may employ a plurality of sensor means for determining whether target structures are knocked down and subsequently scored. Other examples include the use of video graphics, optical holography, sound and other audiovisual effects to simulate games such as bowling or a building demolition using a crane and wrecking ball. Lighting and sound effects can be readily implemented into such a system.

All the features disclosed in this specification, including any accompanying abstract and drawings, may be replaced by alternative features serving the same, equivalent or similar purpose, unless expressly stated otherwise. Thus, unless expressly stated otherwise, each feature disclosed is one example only of a generic series of equivalent or similar features.

Having fully described at least one embodiment of the improved pendulum game apparatus, other equivalent or alternative methods of implementing the improved pendulum game apparatus according to the present invention will be apparent to those skilled in the art. Various aspects of the improved pendulum game apparatus have been described above by way of illustration, and the specific embodiments disclosed are not intended to limit the invention to the particular forms disclosed. For example, embodiments of the improved pendulum game apparatus may be configured to provide a unique gaming experience at arcades, restaurants, bars and the like. In other embodiments, a table top version of the invention may provide a fun and functional gaming apparatus which may also serve as a display and conversation piece. The particular implementation of the improved pendulum game apparatus may vary depending upon the particular context or application. By way of example, and not limitation, the improved pendulum game apparatus described in the foregoing was principally directed to a simple home gaming unit. However, similar techniques may instead be applied to other sized pendulum games which are contemplated as within the scope of the present invention. Additionally, differing combinations and arrangements of display technologies may be implemented to achieve a more desirable appearance. The invention is thus to cover all modifications, equivalents, and alternatives falling within the spirit and scope of the following claims. It is to be further understood that not all of the disclosed embodiments in the foregoing specification will necessarily satisfy or achieve each of the objects, advantages, or improvements described in the foregoing specification.

Although specific features of the improved pendulum game apparatus are shown in some drawings and not others, persons skilled in the art will understand that this is for convenience. Each feature may be combined with any or all of the other features in accordance with the invention. The words "including," "comprising," "having," and "with" as used herein are to be interpreted broadly and comprehensively, and are not limited to any physical interconnection. Claim elements and steps herein may have been numbered and/or lettered solely as an aid in readability and understanding. Any such numbering and lettering in itself is not intended to and should not be taken to indicate the ordering of elements and/or steps in the claims to be added at a later date.

Any amendment presented during the prosecution of the application for this patent is not a disclaimer of any claim element presented in the description or claims to be filed. Persons skilled in the art cannot reasonably be expected to draft a claim that would literally encompass each and every equivalent.

What is claimed is:

1. An improved pendulum game apparatus comprising:

a. a cuboid shaped roof assembly having a base and four side walls;

b. a cuboid shaped foundation assembly having a base and four side walls;

c. a frame assembly which connects the cuboid shaped roof assembly with the cuboid shaped foundation assembly, said frame assembly consisting of two collapsible cross brace assemblies, each cross brace assembly consisting of four frame arms and a crossmember bracket, said crossmember bracket configured to accept the said four frame arms so as to create a cross brace when assembled;

d. a target structure stand assembly, said target structure stand assembly being connectible to the upper side of the base of the cuboid shaped foundation assembly;

e. a plurality of target structures movably attached to the said target structure stand assembly;

f. a pendulum arm having a proximal end and a distal end;

g. a pendulum cable; and h. a pendulum bob.

2. The improved pendulum game apparatus of claim 1 wherein the two collapsible cross brace assemblies connect to mounting points on the lateral sides of the base of the foundation assembly and the base of the roof assembly.

3. The improved pendulum game apparatus of claim 1 wherein the frame assembly which connects the cuboid shaped roof assembly with the cuboid shaped foundation assembly further consists of a third collapsible cross brace assembly, the third collapsible cross brace assembly connecting the posterior sides of the base of the foundation assembly and the base of the roof assembly.

4. The improved pendulum game apparatus of claim 1 wherein the cuboid shaped roof assembly having a base and four side walls and the cuboid shaped foundation assembly having a base and four side walls can be fastened together at the side walls to form a cuboid shaped storage container.

5. The improved pendulum game apparatus of claim 1 wherein the pendulum bob is connected to the pendulum cable.

6. The improved pendulum game apparatus of claim 1 wherein the pendulum cable is connected to the distal end of the pendulum arm.

7. The improved pendulum game apparatus of claim 1 wherein the pendulum arm connects to the cuboid shaped roof assembly having a base and four walls.

8. The improved pendulum game apparatus of claim 1 wherein the plurality of target structures consists of individual target structures having a main target structure body and a stabilizer bracket, each target structure hingedly attached to a target structure stand.

9. The improved pendulum game apparatus of claim 1 wherein specialty targets are mounted to the frame assembly which connects the cuboid shaped roof assembly with the cuboid shaped foundation assembly.

10. An improved pendulum game apparatus comprising:

a. a cuboid shaped roof assembly;

b. a cuboid shaped foundation assembly;

c. a frame assembly which connects the said cuboid shaped roof assembly with the cuboid shaped foundation assembly, said frame assembly consisting of two collapsible cross brace assemblies, each cross brace assembly consisting of four frame arms and a crossmember bracket, said crossmember bracket configured to accept the said four frame arms so as to create a cross brace when assembled;

d. a target structure stand assembly, said target structure stand assembly being connectible to the upper side of the foundation assembly;

e. a plurality of target structures movably attached to the said target structure stand assembly;

f. a pendulum arm having a proximal end and a distal end;

g. a pendulum cable;

h. a pendulum bob; and i. a computer system having at least one processor and memory storing computer readable instructions that, when executed by the at least one processor, cause the improved pendulum game apparatus, by at least one processor, to perform the steps of inputting the number of players, determining player order, receiving signals from sensors in improved pendulum game apparatus, displaying audiovisual effects, tallying scores, determining rankings, and sharing scores and metrics over a network.

11. The improved pendulum game apparatus of claim 10 wherein the computer system having at least one processor and memory storing computer readable instruction is networked and in communication with peripherals and the internet.

12. The improved pendulum game apparatus of claim 10 wherein the two collapsible cross brace assemblies connect to mounting points on the lateral sides of the base of the foundation assembly and the base of the roof assembly.

13. The improved pendulum game apparatus of claim 10 wherein the frame assembly which connects the cuboid roof assembly with the cuboid shaped foundation assembly further consists of a third collapsible cross brace assembly, the third collapsible cross brace assembly connecting the posterior sides of the base of the foundation assembly and the base of the roof assembly.

14. The improved pendulum game apparatus of claim 10 wherein the cuboid shaped roof assembly having a base and four side walls and the cuboid shaped foundation assembly having a base and four side walls can be fastened together at the side walls to form a cuboid shaped storage container.

15. The improved pendulum game apparatus of claim 10 wherein the pendulum bob is connected to the pendulum cable.

16. The improved pendulum game apparatus of claim 10 wherein the pendulum cable is connected to the distal end of the pendulum arm.

17. The improved pendulum game apparatus of claim 10 wherein the pendulum arm connects to the cuboid shaped roof assembly having a base and four walls.

18. The improved pendulum game apparatus of claim 10 wherein the plurality of target structures consists of individual target structures having a main target structure body and a stabilizer bracket, each target structure hingedly attached to a target structure stand.

19. The improved pendulum game apparatus of claim 10 wherein specialty targets are mounted to the frame assembly which connects the cuboid shaped roof assembly with the cuboid shaped foundation assembly.

20. A method for playing a skill game using an improved pendulum apparatus comprising a cuboid shaped roof assembly having a base and four side walls; a cuboid shaped foundation assembly having a base and four side walls; a frame assembly which connects the cuboid shaped roof assembly with the cuboid shaped foundation assembly, said frame assembly consisting of at least two collapsible cross brace assemblies, each cross brace assembly consisting of four frame arms and a crossmember bracket, said crossmember bracket configured to accept the said four frame arms so as to create a cross brace when assembled; a target structure stand assembly, said target structure stand assembly being connectible to the upper side of the base of the foundation assembly; a plurality of target structures movably attached to the said target structure stand assembly; a pendulum arm having a proximal end and a distal end; a pendulum cable; and a pendulum bob; the method comprising the steps of:

a. setting up target structures;

b. players determining playing order;

c. a player grasping pendulum ball;

d. a player aiming pendulum ball at target structures;

e. a player releasing pendulum ball;

f. tallying score;

g. resetting target structures; and h. next player repeats the process.

* * * * *